United States Patent [19]

Rapp

[11] Patent Number: 4,659,237

[45] Date of Patent: Apr. 21, 1987

[54] DRAWER GUIDE

[75] Inventor: Reinhold Rapp, Langenau, Austria

[73] Assignee: Julius Blum Gesellschaft m.b.H., Höchst, Austria

[21] Appl. No.: 804,372

[22] Filed: Dec. 2, 1985

[30] Foreign Application Priority Data

Dec. 20, 1984 [AT] Austria ..... 4037/84

[51] Int. Cl.[4] ..... F16C 29/04

[52] U.S. Cl. ..... 384/19

[58] Field of Search ..... 308/3.8, 6 R, 6 C; 312/341 R, 350, 330 R; 384/19, 17, 55

[56] References Cited

U.S. PATENT DOCUMENTS

| | | | |
|---|---|---|---|
| 2,984,533 | 5/1961 | Sundberg | 308/3.8 |
| 3,013,849 | 12/1961 | Tanner | 308/3.8 |
| 3,050,348 | 8/1962 | Pipe | 308/3.8 |
| 4,121,876 | 10/1978 | Ratti | 312/330 R |

*Primary Examiner*—Lenard A. Footland

*Attorney, Agent, or Firm*—Wenderoth, Lind & Ponack

[57] ABSTRACT

A concealed guide rail assembly includes runner carriages which are guided on each side of a drawer between a respective supporting rail on the side of a furniture body and a pull-out rail on the side of the drawer. The supporting rails have an upwardly open U-shaped profile with horizontally extending marginal flanges. Rollers of the runner carriages move on the upper side as well as on the lower side of the supporting rails, i.e. in the U-shaped profile and at the marginal flanges.

4 Claims, 11 Drawing Figures

DRAWER GUIDE

FIELD AND BACKGROUND OF THE INVENTION

The invention relates to a concealed guide rail assembly, in particular for drawers, comprising on each side of the drawer a pull-out rail to be attached to the drawer and a supporting rail to be attached to the furniture body, the load of the drawer being transmitted by cylindrical runner rollers which are mounted in a runner carriage in adjacent arrangement and which are arranged at least substantially in one horizontal plane, the runner carriages being provided with locking latches or the like which secure the carriages in one of the rail pairs when the supporting and pull-out rails are separated from each other.

DESCRIPTION OF THE PRIOR ART

Guide assemblies are frequently used in modern furniture production, in particular in the production of kitchen and office furniture.

Guide assemblies of this kind facilitate extraction and insertion of a drawer or shelf, they provide smooth running of the drawer or shelf and secure them from tilting when being partly extracted from the furniture body.

Further to this function, such guide assemblies should fulfill the following requirements. They should not, or only to a very limited extent, reduce the loading capacity of the drawer, i.e. as little space as possible should be lost in the direction of the width of the drawer.

Moreover, it has proved advantageous that the runner carriage is covered by the drawer, thus protecting the runner carriage from dust. This not only involves aesthetic advantages but also guarantees functioning of the guide assembly over long periods of use.

It is known to make the side walls of the drawer of plastics material, for example by extrusion. It is further known to arrange the pull-out rails of the guide assembly and the runner carriages in the side wall of the drawer, and it is also known to cover the pull-out rails and the runner carriages towards the outer side by means of downwardly extending covers.

An example of a concealed guide rail assembly, i.e. a guide assembly in which the rails are mounted beneath the bottom of the drawer, is described in AT-PS 362 899. A guide rail assembly of this kind has the advantage that it can be integrated in the piece of furniture without requiring much space and also does not impair the width of the drawer.

SUMMARY OF THE INVENTION

It is the object of the invention to improve a guide rail assembly of the afore-mentioned kind in such a way that also, in the case of heavy drawers, smooth running and stable lateral guiding are obtained.

Stable lateral guiding of this kind has up to the present been obtained by so-called ball bearing pull-out guides wherein ball bearing cages are arranged between the rails and hold steel balls which run on groove-like guide paths of the rails. This kind of guide rail assembly provides good guiding of the drawer but has a number of disadvantages. The pressure between the steel balls and the rails is so great that coated rails cannot be used. Furthermore, these guide rail assemblies have no self-positioning effect because of their complicated profiles, so that a drawer which has not been fully pushed in remains open.

By means of the guide rail assembly according to the invention, the smooth running of a ball bearing guide is combined with the simple construction of a runner carriage guide with cylindrical runner rollers. It should in particular be possible to provide a self-positioning effect, in case the drawer has not been fully pushed in.

According to the invention, this is achieved in that a running flange of the supporting rail has a U-shaped profile with horizontal marginal flanges projecting on both sides, that runner rollers of the runner carriage move in the U-shaped channel and also on the other side of the marginal flanges, and that the pull-out rails embrace the runner carriages in the shape of a C.

It is advantageously provided that the runner rollers in the runner carriage form a quincunx arrangement, when viewed from the top, the center roller running in the U-shaped channel. Thus, good balance of the runner carriage is obtained.

Particularly smooth running of the drawer is obtained in that the running flange of the supporting rail is laterally adjustably held by a fastening angle or the like.

BRIEF DESCRIPTION OF THE DRAWINGS

Below, embodiments of the invention will be described in more detail with reference to the drawings, without limiting the invention to such embodiments, and wherein.

DESCRIPTION OF THE PREFERRED EMBODIMENTS

Figure 1:
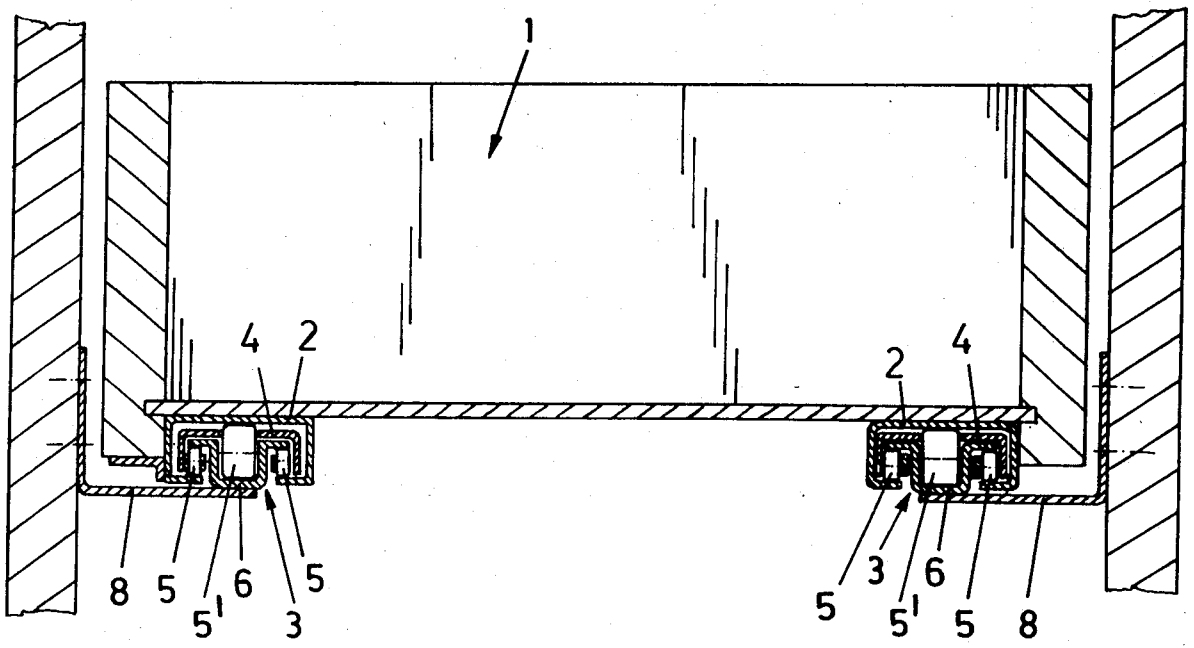
FIG. 1 is a vertical sectional view of a drawer having a guide rail assembly according to the invention.

The guide rail assembly according to the invention comprises in a conventional manner on each side of a drawer 1 a pull-out rail 2 on the side of the drawer and a supporting rail 3 on the side of the furniture body. One runner carriage 4 is arranged between each supporting rail 3 and pull-out rail 2. The pull-out rails 2 are arranged beneath the bottom of the drawer next to the side walls of the drawer. The runner carriages 4 are provided with runner rollers 5, 5' thereof arranged not superjacently, but beside one another.

Due to this arrangement, the guide rail assembly according to the invention requires only very little space in the direction of the height of the piece of furniture.

Figure 2:
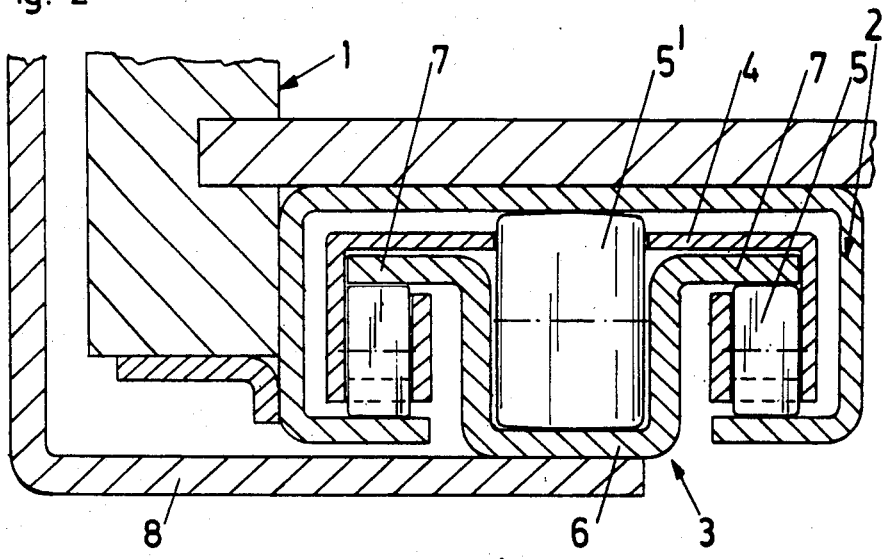
FIG. 2 is a cross-sectional view of one side of the guide rail assembly.
Figure 3:
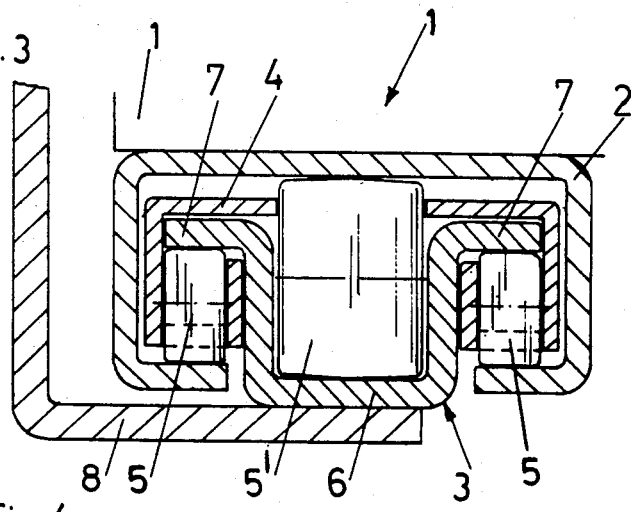
FIG. 3 is a smaller cross-sectional view of a second embodiment of the invention.
Figure 4:
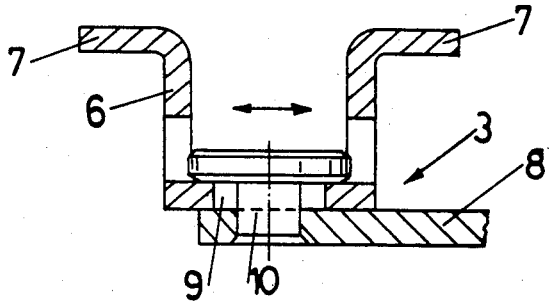
FIG. 4 is a cross-sectional view of an embodiment of a supporting rail.

A guide flange 6 of the supporting rail 3 has, as can be seen from FIGS. 2 to 4, a U-shaped cross-section and comprises two outwardly projecting horizontal marginal flanges 7. The runner roller 5' of the runner carriage 4 moves in the channel formed by the U-shaped profile, and runner rollers move beneath the horizontal flanges 7. In the illustrated embodiment, the runner carriage 4 is provided with four runner rollers 5, which are arranged at the corners thereof, and with one runner roller 5' arranged substantially in the center of the runner carriage 4. The runner roller 5' has a greater diameter than the runner rollers 5.

In the embodiment according to FIG. 2, the running flange 6 of the supporting rail 3 is firmly welded to fastening angle members 8. The supporting rail 3 and the runner carriage 4 are substantially narrower than the pull-out rail 2 so that the drawer 1 can be laterally displaced, which makes compensation of tolerances possible.

In the embodiment according to FIG. 3, the supporting rail 3, the runner carriage 4 and the pull-out rail 2 are relatively precisely positioned relative to one another with respect to the breadth of the drawer, i.e. no lateral displacement between the pull-out rail 2 and the supporting rail 3 is possible. In this case, it is of advantage, when, as shown in FIG. 4, the running flange 6 of the supporting rail 3 is adjustably held at the fastening angle member 8. Such adjustability must only be possible, however, during mounting of the piece of furniture. As, for example, shown in FIG. 4, the running flange 6 may have a slot 9 which extends in the direction of the breadth of the drawer and through which projects a rivet 10 which is mounted in the fastening angle member 8. Hence, the running flange 6 can be adjusted in the direction of double arrow B. After such adjustment, the running flange 6 is finally riveted to the fastening angle member 8.

It will be sufficient to arrange such means for the compensation of tolerances on one side of the drawer. On the other side of the drawer, the running flange 6 is advantageously firmly fixed to the fastening angle member, for example riveted thereto.

The pull-out rails 2 may be arranged beneath the drawer side wall as well as, as shown in FIG. 2, in a recess between the drawer side wall and the bottom of the drawer.

The profiles of the supporting rails 3 according to the invention and the arrangement of the runner rollers 5,5' in the runner carriages 4 provide optimal stability of the guide rail assembly.

Figure 9:
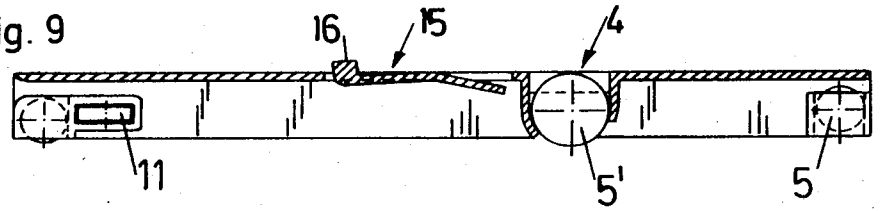
FIG. 9 is a longitudinal sectional view of a runner carriage.
Figure 10:
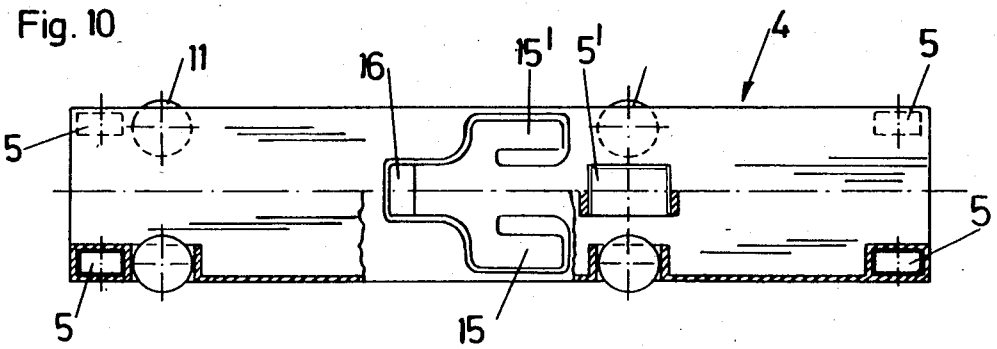
FIG. 10 is a top view of the runner carriage.
Figure 11:
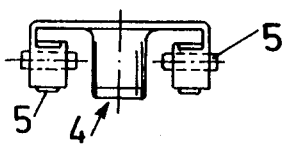
FIG. 11 is a front view of the runner carriage.

To improve lateral guiding, lateral compensating rollers 11 are arranged in the runner carriage 4, as shown in FIGS. 9 and 10.

The supporting rails 3 and the pull-out rails 2 are provided wih stops 12 and 14, respectively, for the runner carriages 4 which serve for the guiding of the runner carriages 4.

Each runner carriage 4 has a latch 15 which comprises two legs 15' which move, during normal functioning of the guide rail assembly, along the upper side of the horizontal flanges 7.

Then the drawer 1 is completely taken out of the body of the piece of furniture, i.e. the pull-out rails 2 are separated from the supporting rails 3, the latch 15 engages with a locking projection 16 into a recess 17 in the pull-out rail 2, and the respective runner carriage 4 is secured in the pull-out rail 2 and together therewith can be pulled out of the supporting rail 3.

When the drawer 1 is being inserted into the body of the piece of furniture, i.e. when the pull-out rail 2 is inserted into the supporting rail 3, the runner carriages 4 are automatically unlocked.

At the front ends of the pull-out rail 2, stop members 18 are provided which prevent tilting of the inserted drawer 1 and, if desired, also permit a vertical alignment of the drawer 1.

Figure 5:
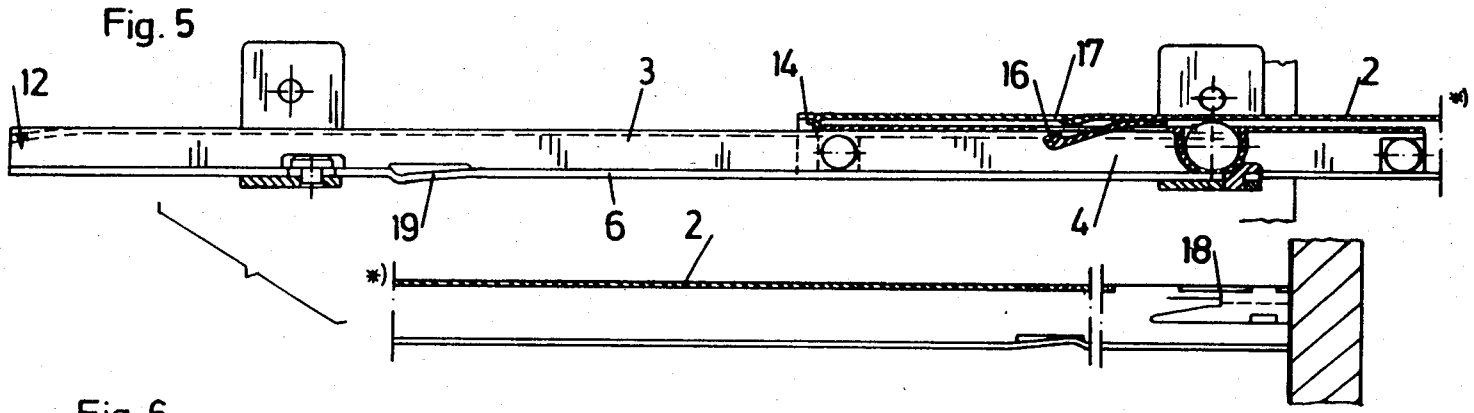
FIG. 5 is a longitudinal sectional view of one side of a guide rail assembly shown in an extracted position.
Figure 6:
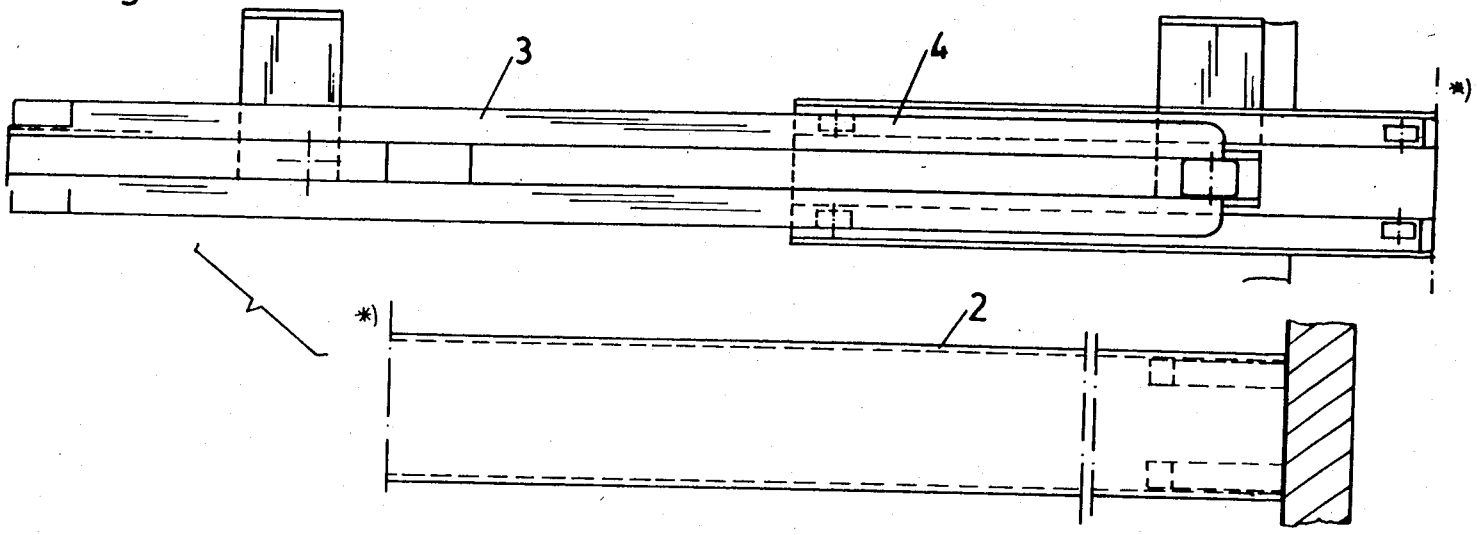
FIG. 6 is a top view of one side of a guide rail assembly.
Figure 7:
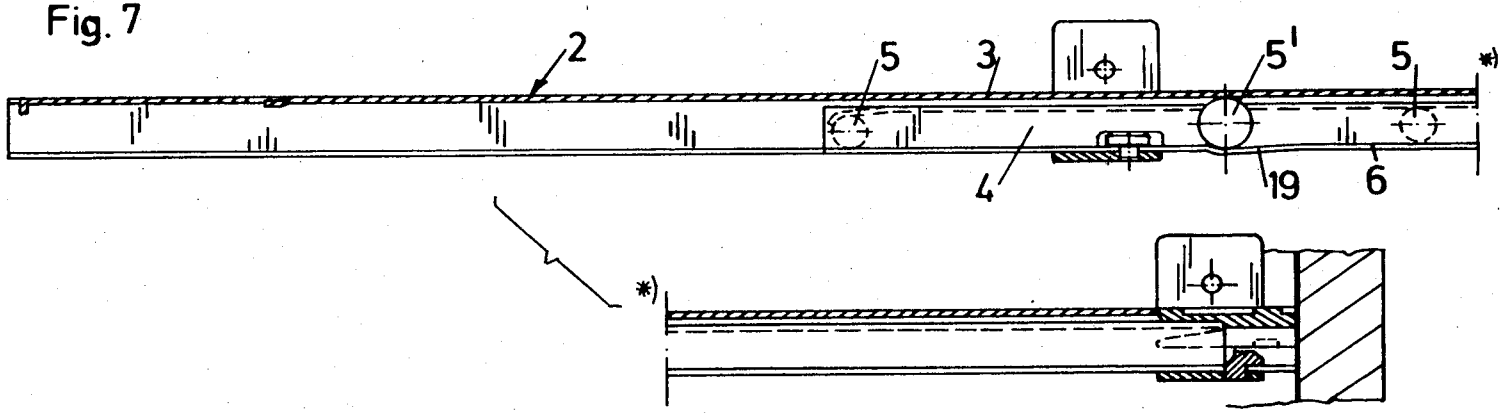
FIG. 7 is a longitudinal sectional view of a guide rail assembly shown in an inserted position.
Figure 8:
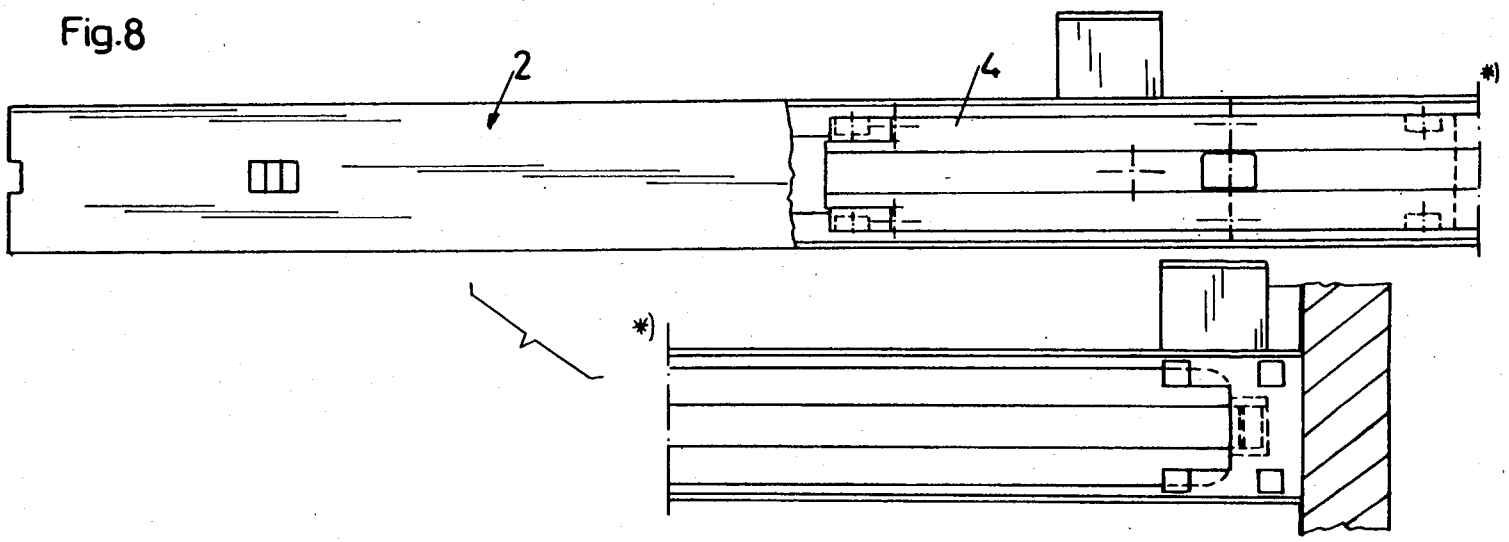
FIG. 8 is a top view of the guide rail assembly in the inserted position.

As can be seen from FIGS. 5 and 7, the running flanges 6 of the supporting rail 3 are provided with rearwardly slanted or inclined regions which form self-positioning means 19. Due to self-positioning means 19, a drawer which has not been fully closed will be drawn into the body of the piece of furniture by its own weight.

As already mentioned, the runner rollers 5, 5' are preferably made of plastics material, so that the guide rail assembly needs no lubrication and remains free of grease, which is a considerable advantage. The rails 2, 3 are advantageously coated with plastics material.

What is claimed is:

1. A concealed guide rail assembly for use on each of opposite sides of an article of furniture for guidin movement of a member such as a drawer into and out of a furniture body, said assembly comprising:

a pull-out rail to be mounted on the drawer;

a supporting rail to be mounted on the furniture body;

cylindrical runner rollers mounted in a runner carriage in adjacent arrangement and lying at least substantially in one plane for transmitting the load of the drawer;

said runner carriage having a locking latch for securing said carriage to one of said rails when said supporting and pull-out rails are separated from each other;

said supporting rail having a running flange having a U-shaped configuration having extending from opposite sides thereof horizontal marginal flanges;

said runner rollers of said runner carriage running in a U-shaped channel of said running flange and on the opposite side of said running flange at said marginal flanges; and said pull-out rail having a C-shaped configuration embracing said runner carriage.

2. A concealed guide rail assembly as claimed in claim 1, wherein said runner rollers in said runner carriage form a guincunx arrangement, when viewed from the top, the central one of said runner rollers running in said U-shaped channel.

3. A concealed guide rail assembly as claimed in claim 2, wherein said central runner roller has a greater diameter than the other of said runner rollers.

4. A concealed guide rail assembly as claimed in claim 1, wherein said running glange of said supporting rail is laterally adjustably supported held by a fastening angle member.

* * * * *